United States Patent [19]

Robertson

[11] Patent Number: 4,646,593

[45] Date of Patent: Mar. 3, 1987

[54] LOOPED STRAP WRENCH FOR ROTATING CYLINDRICAL OBJECTS

[75] Inventor: Charles D. Robertson, Shelby, N.C.

[73] Assignee: Plastic Oddities, Inc., Shelby, N.C.

[21] Appl. No.: 819,258

[22] Filed: Jan. 16, 1986

[51] Int. Cl.[4] ..... B25B 13/52

[52] U.S. Cl. ..... 81/64; 81/3.43

[58] Field of Search ..... 81/64, 3.43, 65.2, 68

[56] References Cited

U.S. PATENT DOCUMENTS

| | | | |
|---|---|---|---|
| 3,678,788 | 7/1972 | Matti | 81/64 |
| 3,837,244 | 9/1974 | Schera | 81/64 |
| 3,962,936 | 6/1976 | Lewis | 81/64 |
| 4,221,140 | 9/1980 | Bracey et al. | 81/64 |
| 4,506,568 | 3/1985 | Aamodt | 81/64 |

*Primary Examiner*—Frederick R. Schmidt
*Assistant Examiner*—Bradley I. Vaught
*Attorney, Agent, or Firm*—Laurence R. Brown

[57] ABSTRACT

This invention provides an improved and simplified tool for rotating a cylindrical object as conventionally accomplished by a pair of pliers or a pipe wrench, but protecting the circumference of the object from damage. A standard length of rod having a polygonal cross section the sides of which intersect at sharply defined fulcrum points, generally square or hexagonal, from a conventional socket wrench set will make it perform the additional function as a multipurpose tool simply by extending an axial slit inwardly from one end to receive thereinto a flexible strap forming a loop about the cylindrical object. The polygonal shape provides fulcrum corners gripping the strap as it is wrapped about the rod to tightly grip and rotate the cylindrical object and thus prevent circumferential slip which together with elasticity in the strap significantly reduces the leverage necessary to rotate the cylindrical objects with small diameter rods.

2 Claims, 4 Drawing Figures

LOOPED STRAP WRENCH FOR ROTATING CYLINDRICAL OBJECTS

TECHNICAL FIELD

This invention relates to socket wrench type tools and more particularly it relates to the multiple function wrenches for gripping and rotating cylindrical objects such as pipes or oil filters.

BACKGROUND ART

Many special purpose tools are known in the art including flexible strap grippers for removing cylindrical oil filters. However specialty tools take up too much space or are expensive additions to a tool box particularly when used only occasionally. In general a pipe wrench and an oil filter removal wrench have been separate expensive and space hogging tools. On the other hand socket wrench systems are standard tool box items with attachments for reaching cramped working spaces and for providing extra leverage or ratcheting functions and the like.

For gripping and rotating cylindrical objects such as pipes and oil filters, special problems are posed. Metallic tools such as pliers and pipe wrenches are apt to scar and damage the exterior surfaces of the objects being gripped. Even more important, they cannot be used in cramped working quarters such as those about car engines, because of large size, long handles at the gripping site and the need for large turning arcs in order to produce high torque for initially breaking loose and then rotating in situ a cylindrical workpiece. Special tools employing a flexible strap for gripping and rotating cylindrical objects are described in U.S. Pat. Nos. 3,962,936, June 15, 1976, issued to W. H. Lewis and 4,221,140, Sept. 9, 1980, issued to B. B. Bracey, et al.

However, such prior art tools have several disadvantages. In each of these patents, for example, a separate specially designed accessory fitting is required for use only occasionally in the operation of the flexible strap.

Additionally, the functional operation of the flexible strap in gripping the cylindrical object is deficient, since it may slip or stretch unduly under high torque conditions. In practice the gripping strap is a fabric of the type that is used for seat belts and thus is subject to stretch. That is a significant disadvantage causing a very small working bite of the rotating leverage arm, particularly with a small diameter rod around which the strap is wound making the effective lever arm of the rotating member short. However, the small diameter is desirable for greater torque in initial unseating of an oil filter or pipe, and for taking up little storage space in a toolbox.

In these prior art tools, the effective working lever arm length of the rotating member is considerably decreased because of the combined strap slippage and stretch which accompanies the required wrapping of the strap material about the rotor lever rod used to exert the force on the strap for rotating in situ the cylindrical object, oil filter or the like.

Accordingly it is an object of this invention to provide simpler less costly tools of the aforesaid type that nevertheless correct the deficiencies of the prior art, take little storage space in a toolbox, have an extended range of utility and afford superior functional performance in the loosening and rotating of threaded cylindrical objects. Other objects features and advantages of the invention will be found throughout the following description, drawings and claims.

DISCLOSURE OF THE INVENTION

In accordance with this invention a gripping and rotating strap about the circumference of a cylindrical object is engaged by a multipurpose, easily stored tool comprising a small diameter hexagonal or square rod that has an axial slit extended inwardly from one end of the rod for engaging and rolling up the strap. A hole may be passed through the rod near the other end for engaging a screw driver or rod used for rotating the rod. This rod thus may be used as an extension rod member for a mating socket wrench set in the same manner of rotation with a screw driver or rod. The slit may enhance a friction fit into a socket by its outwardly springing characteristic. With this torque member the strap is engaged in a different manner, namely by locking into a strap position with an edge of the multilaterally shaped body of the rod to confine any strap slippage or stretching to a very short length of the strap.

By having an open ended slot in the torque rod, a loose length of strap material may be located in a tight working space about the cylindrical workpiece to be rotated before small diameter torque rod need be positioned to grip the strap in the slotted end. Then when the torque rod is rotated to grip and rotate the cylindrical object the edges between the multilateral faces of the rod dig into the strap and compress it against the outer surface of the cylindrical workpiece for a better grip with less strap slip and stretch. Thus the function of the tool system provided by this invention is considerably enhanced without the requirement to carry a further special single purpose tool other than the strap, which in any event is required with specially designed single purpose accessory attachments of the prior art.

Improved functional performance afforded by the structural differences of this invention permit a small diameter socket wrench rod to effectively produce a much greater leverage on the strap to better grip and rotate the cylindrical object with less wasted motion due to strap stretch or poor grip, because the sharp corners of the multilaterally sided socket rod serve to frictionally engage and bite into the strap to prevent slippage of the belt about the rod shaft to reduce the tool effectiveness.

BRIEF DESCRIPTION OF THE DRAWINGS

Thoughout the various views like reference characters are used to designate similar features to facilitate comparison. In the Drawings.

THE PREFERRED EMBODIMENT

Figure 1:
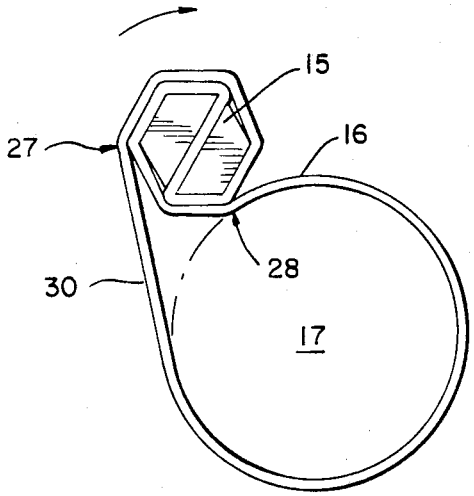
FIG. 1 is a top plan view of a tool as afforded by this invention gripping for rotation a circular object.

As may be seen by reference to the drawings, a torque rod 15 which also may serve as a socket wrench system extender rod, has a multilterally sided cross section, generally square or hexagonal. Thus the torque rod is a rotary gearlike member which by means of the intermediately disposed flexible strap 16 grips and rotates the cylindrical object 17, for example an oil filter in situ in a tight location with little room for access, maneuvering a wrench or inserting a wrench body. The rod 15 is preferably a socket wrench extension rod made operable to grip the flexible strap by providing an axial slit 18 extending inwardly from one end with dimensions for snugly receiving the strap 16 width and thickness thereinto and preferably to give a springlike force for better retention of the torque rod 15 in the socket cylinder 19. Furthermore, the hole 22 is provided of such diameter that it may receive a rod such as a screw driver shaft for manually rotating the torque rotor rod.

The rotor rod 15 slit 18 has the advantages including (1) being very low cost and eliminating a special accessory tool, (2) providing the freedom to first place the strap 16 about the cylindrical object 17, etc. and thereafter engaging the strap 16 into the slit 18, (3) being a part of a socket wrench system which affords various adaptors such as socket 19, universal joint 20 and lever arm 21 for rotating the rotor rod 15 in places without easy access such as automobile engines, (4) requiring extra tool box storage space only for the straps 16 for use on cylindrical objects of various and large sizes, and (5) frictionally securing by outward spring pressure, the rod body in socket 19.

Particular advantages are afforded by using the polygonal sided rod 15 as the lever rotor for wrapping and tightening the flexible strap 16. As may be seen from FIGS. 1 and 2 the corners of the rotor rod 15 formed by the meeting of the multiple sides defines fulcrums which frictionally engage the strap 16 when wrapped therearound. This considerably reduces the slippage of the strap about the rod 15 when under strain or tension in the gripping and object rotating mode. Because of the stretch in the fabrics useful for the strap, the rotation angle of the rotor to effect the desired rotation of object 17 is increased undesirably by any such slippage. For greater rotor rod 15 to strap friction, the square or hexagonal rods 15 are preferred.

Further the operation is advantageously improved by this frictional coupling feature. Thus, with clockwise rotor rod 15 rotation, suggested by the curved arrow, the rotor leverage arm is increased to substantially the diameter of the rod 15, as may be seen by considering the points identified by arrows 27 and 28. Because of the friction feature slippage of the strap 16 about the rod 15 may now be ignored. Thus the lever arm from 28 to 27 effectively pulls on the strap segment 30 between its tangential contacts respectively with the rotor rod 15 and object to be rotated 17. With a circular rotor rod, the length of the strap portion being pulled by the rotor rod could effectively extend entirely about the rod to the point 28. This is disadvantageous in two ways, namely that a greater length of the strap is subject to elastic distortion by stretch that is wasted without effecting the desired work, and that the effective lever arm is considerably shortened, possibly to a very short distance, because of the slippage.

Figure 2:
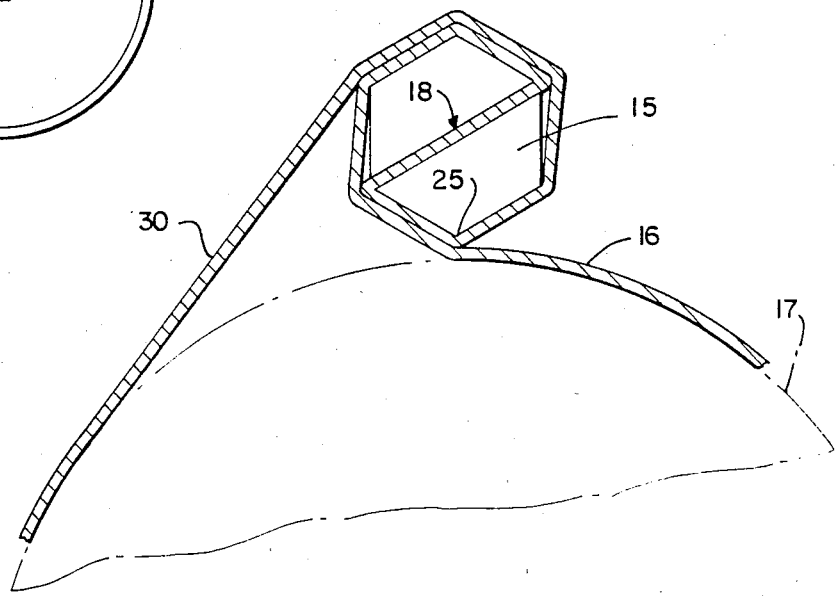
FIG. 2 is an enlarged segmental view, with hatching to emphasize the strap, showing the strap to rotor rod interaction afforded by this invention.
Figure 3:
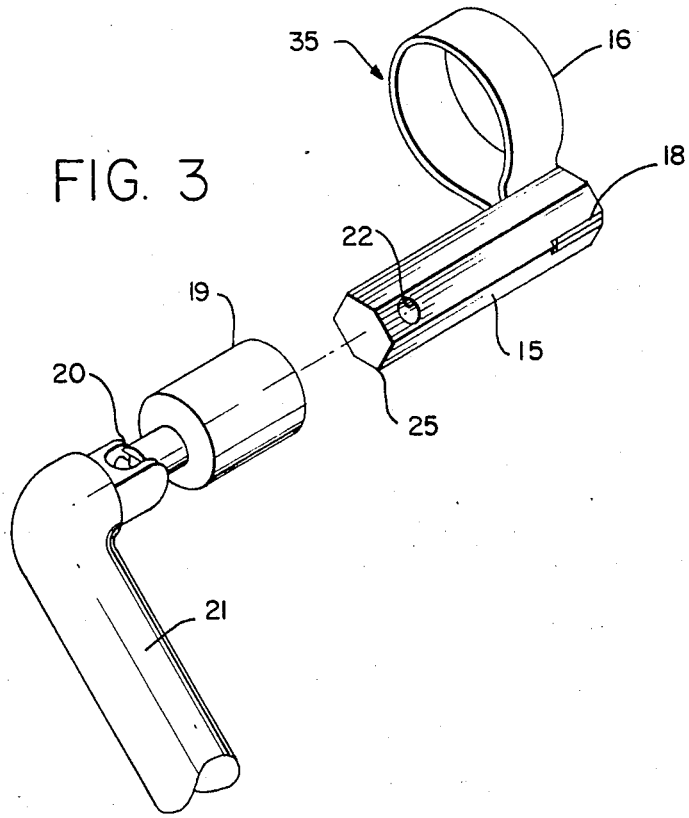
FIG. 3 is a perspective sketch of a socket wrench system embodying the invention.
Figure 4:
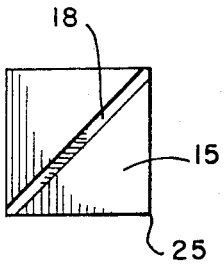
FIG. 4 is an end view of a further torque rod rotor embodiment as afforded by this invention.

The rotor rod 15 slit 18 may be used either with the enless belt strap configuration of FIG. 2 or the configuration of FIG. 3 wherein the two ends of a length of strap material may extend through the slit. This latter configuration is advantageous for engaging a rotatable cylindrical workpiece such as an oil filter in a tight location where the strap is put in place and the rod 15 may be threaded through a set of otherwise interfering parts or bodies to there engage the two strap ends at a position adjacent the workpiece.

In operation, the width of a flexible strap is inserted into a slot 18 running axially inwardly from one end of a multilaterally sided wrench rod to form a loop 35 for cylindrically surrounding the desired cylindrical object. The strap is then rolled about the rod 15 by rotating the rod with a mating wrench attachment to the rod (19, 20 and 21, or the like). Alternatively a screw driver can be inserted in hole 22 to rotate the rod 15, an extension rod can be attached, or other tools such as open ended wrenches can engage the rod 15 anywhere along its length at an accessible position.

Furthermore the polygonal shape of the rod 15 provides fulcrum corners 25 which frictionally engaging the strap thereby reducing slippage of the strap about the rod and applies greater turning torque and reliabilty for rotation of the cylindrical workpiece, as hereinbefore described.

It is therefore evident that this invention has improved the state of the art, and thus those novel features believed descriptive of the spirit and scope of the invention are defined with particularity in the following claims.

I claim:

1. A wrench assembly for gripping and rotating a cylindrical object comprising in combination, a longitudinal metal wrench rod having a polygonal side cross section the sides of which intersect at sharply defined fulcrum points adapted to receive other mating wrench attachments, a flexible gripping strap of predetermined width and a length long enough to surround the cylindrical object, an axial slit extending inwardly from one end of said rod having an axial length and a slot width adapted to receive snugly fitting thereinto said strap across its width to thereby be engaged by the fulcrum points of the rod defined by the meeting of the multiple sides when wrapped firmly about the rod without a tendency to slip about the circumference of the rod when the rod is rotated, and a loop formed by a strap held in said slit gripping the circumference of a cylindrical object to be rotated and wrapped about the rod as a leverage mechanism to rotate the cylindrical object by pulling on a strap portion located between the rod and the circumference of the cylindrical object when the rod is rotated, whereby a lever arm on the rotatable rod for effecting rotation of the cylindrical object is defined between the tangential contact position of the outer strap layer wrapped about the rod in engagement with the fulcrum points of the effective circumference of the rod formed together with the strap wound thereabout on the next innermost strap layer and the peripheral contact surface on the circumference of the cylindrical object to be rotated with the strap portion wrapped about the rod.

2. A wrench assembly as defined in claim 1 defining an aperture through the rod perpendicular to the body axis thereof having a diameter to receive a longitudinal member thereinto for rotating the rod.

* * * * *